US009662804B2

(12) United States Patent
Wiesner et al.

(10) Patent No.: US 9,662,804 B2
(45) Date of Patent: May 30, 2017

(54) METHOD FOR SLICING WAFERS FROM A WORKPIECE BY MEANS OF A WIRE SAW

(71) Applicant: Siltronic AG, Munich (DE)

(72) Inventors: Peter Wiesner, Reut (DE); Robert Kreuzeder, Wurmannsquick (DE)

(73) Assignee: SILTRONIC AG, Munich (DE)

( * ) Notice: Subject to any disclaimer, the term of this patent is extended or adjusted under 35 U.S.C. 154(b) by 69 days.

(21) Appl. No.: 14/557,479

(22) Filed: Dec. 2, 2014

(65) Prior Publication Data

US 2015/0158203 A1 Jun. 11, 2015

(30) Foreign Application Priority Data

Dec. 6, 2013 (DE) ..... 10 2013 225 104

(51) Int. Cl.
*B28D 5/04* (2006.01)

(52) U.S. Cl.
CPC ..... *B28D 5/045* (2013.01)

(58) Field of Classification Search
CPC ..... B28D 5/045
USPC ..... 125/21, 16.02
See application file for complete search history.

(56) References Cited

U.S. PATENT DOCUMENTS 4,655,191 A 4/1987 Wells
5,287,774 A 2/1994 Seifert
5,377,568 A 1/1995 Hauser
5,575,189 A * 11/1996 Kiuchi ..... B23D 57/0053 125/16.02
5,758,633 A * 6/1998 Hauser ..... B23D 57/0053 125/16.02
6,390,896 B1 5/2002 Huber
2002/0174861 A1 11/2002 Lundt et al.
2008/0264228 A1 10/2008 Huber et al.
2010/0089377 A1* 4/2010 Oishi ..... B28D 5/0064 125/16.02
2010/0258103 A1 10/2010 Kitagawa
2012/0240914 A1* 9/2012 Huber ..... B23D 57/0053 125/21
2012/0240915 A1* 9/2012 Huber ..... B23D 57/0053 125/21

FOREIGN PATENT DOCUMENTS

CN 1385288 A 12/2002
DE 19510625 A1 9/1996
(Continued)

*Primary Examiner* — Larry E Waggle, Jr.
*Assistant Examiner* — Henry Hong
(74) *Attorney, Agent, or Firm* — Leydig, Voit & Mayer, Ltd.

(57) ABSTRACT

A method for sawing a multiplicity of wafers from a workpiece by means of a wire web of a wire saw includes providing a wire web consisting of a plurality of parallel wire sections. The wire web is spanned by at least two wire guide rollers where each wire guide rollers comprises a core having two side surfaces and a lateral surface. The core is composed of a first material. Each core is rotatably mounted along its longitudinal axis and comprises at least two separate cavities. The lateral surface of each core is enclosed by a jacket composed of a second material. Parallel groves are cut into the jacket for guiding the wire sections of the web. The length of the jacket is altered thermally by means of at least one cavity being filled with a temperature regulating medium.

20 Claims, 6 Drawing Sheets

(56) References Cited

FOREIGN PATENT DOCUMENTS

| | | | |
|---|---|---|---|
| DE | 69304212 | T2 | 2/1997 |
| DE | 69511635 | T2 | 3/2000 |
| DE | 10220640 | A1 | 12/2002 |
| DE | 69715061 | T2 | 4/2003 |
| DE | 102007019566 | A1 | 10/2008 |
| DE | 112008003339 | T5 | 12/2010 |
| DE | 102011005949 | A1 | 9/2012 |
| EP | 0522542 | A1 | 1/1993 |
| EP | 0875325 | A1 | 11/1998 |
| EP | 0990498 | A1 | 4/2000 |
| JP | 2002086339 | A | 3/2002 |

* cited by examiner

METHOD FOR SLICING WAFERS FROM A WORKPIECE BY MEANS OF A WIRE SAW

CROSS REFERENCE TO OTHER RELATED APPLICATIONS

This application claims priority from German Patent Application No. DE 102013225104.1 filed Dec. 6, 2013, which is hereby incorporated by reference herein in its entirety.

FIELD

The invention relates to a method for sawing a multiplicity of wafers from a workpiece by means of a wire web of a wire saw, said wire web consisting of many wire sections, which method improves the geometry and waviness of the cut wafers by means of targeted influencing of the expansion of the jacket of the wire guide rollers spanning the wire web.

BACKGROUND

For electronics, microelectronics and microelectromechanics, wafers composed of semiconductor material (semiconductor wafers) with extreme requirements to global and local flatness (nanotopology) are required as starting materials.

A wafer composed of semiconductor material is usually a silicon wafer, or a substrate having layer structures derived from silicon, such as, for example, silicon-germanium (SiGe), silicon carbide (SiC), or gallium nitride (GaN).

In accordance with the prior art, semiconductor wafers are produced in a multiplicity of successive process steps, wherein, in the first step, by way of example, a single crystal (rod, ingot or boule) composed of semiconductor material is pulled by means of the Czochralski method or a polycrystalline block composed of semiconductor material is cast, and, in a further step, the resulting circular-cylindrical or block-shaped workpiece composed of semiconductor material is separated into individual wafers by means of wire saws.

In this case, a distinction is made between single-cut wire saws and multiple wire saws, designated hereinafter as MW wire saws (MW=multiple wire). MW wire saws are used, in particular, when a workpiece, for example a rod composed of semiconductor material, is intended to be sawn into a multiplicity of wafers in one work step.

An MW wire saw is described in EP 990 498 A1, for example. In this case, a long sawing wire coated with bonded abrasive grain runs spirally over wire guide rollers and forms one or more wire webs.

In general, the wire web is formed by a multiplicity of parallel wire sections which are spanned between at least two wire guide rollers, wherein the wire guide rollers are mounted rotatably and at least one of them is driven.

The wire sections of the wire web can belong to a single, finite wire that is guided spirally around the roller system and is unwound from a supply spool (payoff spool) onto a receiving spool (pickup spool). The patent specification U.S. Pat. No. 4,655,191, by contrast, describes an MW wire saw wherein a multiplicity of finite wires are provided and each wire section of the wire web is assigned to one of said wires. EP 522 542 A1 describes an MW wire saw wherein a multiplicity of continuous wire loops run around the roller system.

The longitudinal axes of the wire guide rollers are oriented perpendicularly to the sawing wire in the wire web.

The wire guide rollers generally consist of a core composed of metal, which is usually enclosed longitudinally with a jacket, for example composed of polyurethane. The jacket has a multiplicity of grooves that serve for guiding the sawing wire which establishes the wire web of the wire saw. A wire guide roller optimized with regard to surface coating and groove geometry is describes in DE 10 2007 019 566 A1.

The production of wafers composed of semiconductor material makes particularly stringent requirements on the precision of the slicing process. The sawn wafers are intended to have plane-parallel side surfaces which are as flat as possible. In order that the sawn wafers can arise with such a geometrical characteristic, an axial relative movement between the workpiece and the wire sections of the saw web, that is to say a relative movement parallel to the central axis of the workpiece, must be avoided during the sawing process.

For this purpose, it is important that the multiplicity of grooves in the jacket of the wire guide roller run exactly parallel and the grooves and the sawing wire lie in one line (alignment) and the position or the cut-in angle relative to the workpiece does not change. If such a change (alignment error) takes place, wafers having a curved cross section (warp) arise.

As a cause of the change in the position or the cutting angle of the wire sections of the saw web, that is to say the relative movement of the wire sections parallel to the central axis of the workpiece, US 2010/0089377 A1 mentions temperature changes and an associated thermal expansion or thermal contraction of the workpiece and of the wire guide rollers.

In the course of the sawing process lasting a number of hours, heat arises both as a result of the sawing process itself and as a result of the sawing wires running around the wire guide rollers, said heat being transferred to the workpiece to be sawn and also to the wire guide rollers.

According to DE 10 2011 005 949 A1, thermal expansion of a single crystal composed of silicon having a diameter of 300 mm is approximately 25 μm if the single crystal is heated by 30° C. during wire sawing. Thermal expansion can be avoided by the single crystal being cooled during sawing.

In accordance with the prior art, thermal expansion or thermal contraction (thermally induced change in length) of the workpiece is minimized for example by a cooling medium being applied to the workpiece during wire sawing. However, the effect of this cooling on the wire guide rollers usually is insufficient for maintaining strictly stable thermal conditions.

The heat that arises as a result of the wire sawing process can also lead to a thermal expansion of the wire guide rollers spanning the wire web, as a result of which an alignment error can occur, that is to say that the sawing wire no longer cuts into the workpiece at the angle applicable at the beginning of the sawing process. Thermal expansion of the wire guide rollers spanning the wire web can thus lead to an impaired wafer geometry in the sliced semiconductor wafers.

There are various approaches in the prior art for minimizing or avoiding the alignment error caused by thermal expansion of the wire guide roller and/or of the jacket enclosing the core of the wire guide roller.

The document DE 11 2008 003 339 T5 describes a method wherein the temperature of the slurry fed to the wire web is increased continuously from the beginning to the end of the slicing process. The method is based on the observation that with increasing length of engagement and with increasing progress of the slicing process, the rod becomes hotter and hotter and the position of the slicing gaps relative to the other components, in particular the wire guide rollers, thus shifts. This leads to wafers having front and rear sides substantially curved relative to the intended plane of cutting. The continuous increase in the temperature of the wire and of the wire guide rollers by means of hotter and hotter slurry over the cut ideally brings about a thermal expansion of the wire guide rollers synchronously with and to the same extent as the rod, such that wafers having substantially flat front and rear sides are obtained.

The German patent application DE 10 2011 005 949 A1 describes cooling the wire guide rollers and the fixed bearings thereof independently of one another.

DE 102 20 640 A1 and DE 693 04 212 T2 describe methods for monitoring and, if appropriate, correcting the alignment of the sawing wire with respect to the grooves in the jacket of the wire guide rollers. By way of example, DE 693 04 212 T2 describes a positional control of the wire guides which constantly measures the position of the wires by means of a detection system, wherein the detection system cooperates with a compensation device in order to keep the position of the wire guides unchanged relative to the workpiece to be sawn. However, the detection system can be influenced both by the grinding medium and by the abraded material arising as a result of the sawing process to the effect that measurement errors occur.

The German patent application DE 195 10 625 A1 describes the use of wire guide rollers composed of a glass-ceramic material that tends toward a very low thermal expansion, which are additionally mounted between a fixed bearing and a movable bearing in order to compensate for a thermal expansion of the wire guide roller. Glass-ceramic materials have proved to be unsuitable in practice with the use of a grinding medium containing abrasives, since the sawing wires cut into the workpiece after a relatively short time.

A further method for avoiding thermal expansion of the wire guide rollers in a wire saw is to set a constant temperature in the core of the wire guide roller by means of a corresponding temperature-regulating device.

The patent specification DE 695 11 635 T2 describes a wire guide roller having a core subdivided into two inner regions, a coolant circulating in said core. A temperature gradient within the core is intended to be avoided by means of the two independent chambers.

In addition to avoiding thermally induced expansion of the core of the wire guide roller, avoiding or restricting thermal change in length of the jacket longitudinally enclosing the core of the wire guide roller is also crucial since the jacket with its grooved profile directly influences the alignment of the wire sections relative to the workpiece. Thermally induced change in length of the jacket of the wire guide roller is dependent, in particular, on the coefficient of linear expansion of the jacket material, on the thickness of the jacket and on the quantity of heat arising during the sawing process.

The jacket is typically fixed on the core of the wire guide rollers in such a way that it can expand or contract axially at both ends in an unimpeded manner in the event of a temperature change. DE 10 2011 005 949 A1 describes a method for slicing wafers from a workpiece by means of a wire saw, wherein the fixed bearing of the wire guide rollers and the wire guide roller are cooled independently of one another in order to reduce or completely prevent an axial relative movement of the workpiece and of the wire sections of the wire web that are guided by the wire guide rollers during the sawing process, that is to say that an equidirectional change in length of the coating and of the fixed bearing is effected in reaction to a change in length of the workpiece during the sawing process.

Furthermore, the application DE 10 2011 005 949 A1 describes that the change in length of the jacket can be restricted within certain limits by the coating being clamped onto the underlying core of the wire guide roller, for example by clamping rings arranged at both ends of the coating. The clamping rings fix the jacket on the core of the wire guide roller and restrict a change in length of the jacket that is caused by a temperature change.

However, DE 10 2011 005 949 A1 does not teach a method of utilizing the different expansion of the core material and the jacket surrounding the core of the wire guide rollers spanning the wire web in a targeted manner for improving the geometry and the waviness of the wafers sliced from a workpiece.

SUMMARY

In an embodiment, the present invention provides a method for sawing a multiplicity of wafers from a workpiece by means of a wire web of a wire saw including providing a wire web consisting of a plurality of parallel wire sections. The wire web is spanned by at least two wire guide rollers where each wire guide rollers comprises a core, each core having two side surfaces and a lateral surface. The core is composed of a first material. Each core is rotatably mounted along its longitudinal axis and comprises at least two separate cavities. The lateral surface of each core is enclosed by a jacket composed of a second material. Parallel groves are cut into the jacket for guiding the wire sections of the web. The length of the jacket is altered thermally by means of at least one cavity being filled with a temperature regulating medium.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
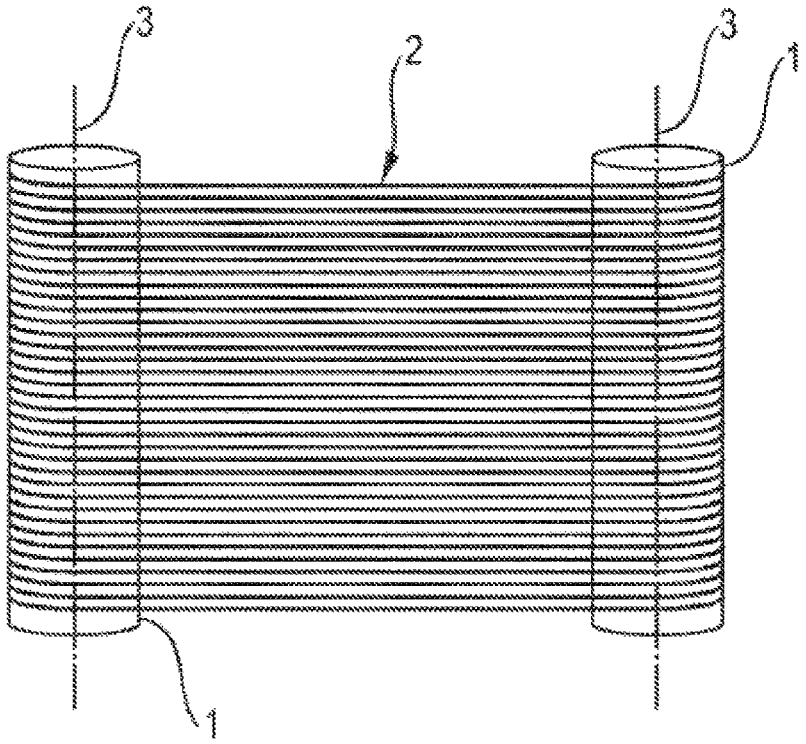
FIG. 1: Example according to an embodiment of the invention showing the basic construction of a wire web of the wire saw.

An aspect of the present invention is to provide an improved method for sawing a multiplicity of wafers from a workpiece composed of semiconductor material, wherein, by means of the targeted influencing of the length of the wire guide rollers spanning the wire web, comprising a core composed of a first material and a jacket composed of a second material and enclosing the lateral surface of the core, a thermally induced change in length of a workpiece is compensated for and the geometry and waviness of the wafers sliced from the workpiece are improved as a result.

An aspect of the present invention can be achieved by means of a method for sawing a multiplicity of wafers from a workpiece by means of a wire web of a wire saw, said wire web consisting of many parallel wire sections, wherein the wire web is spanned by at least two wire guide rollers (1), the wire guide rollers (1) each comprising a core (1*a*) having two side surfaces and a lateral surface, composed of a first material, each core (1*a*) is mounted rotatably along its longitudinal axis and comprises at least two separate cavities (5), the lateral surface of each core (1*a*) is enclosed by a jacket (1*b*) composed of a second material, and parallel grooves for guiding the wire sections of the wire web are cut into the jacket (1*b*), wherein the length of the jacket (1*b*) is altered thermally by means of at least one cavity (5) being filled with a temperature-regulating medium.

The invention and preferred embodiments are described in detail below.

The invention comprises a method for sawing a multiplicity of wafers from a workpiece, preferably a workpiece composed of a semiconductor material.

Semiconductor materials are compound semiconductors such as, for example, gallium arsenide or elemental semiconductors such as principally silicon and occasionally germanium.

A workpiece is a geometrical body having a surface consisting of at least two parallel, planar surfaces (end faces) and a lateral surface delimited by the end faces. In the case of a circular cylindrical body, the end faces are round and the lateral surface is convex. In the case of a parallelepipedal cylindrical workpiece, the lateral surface comprises four plane individual faces.

The method according to embodiments of the invention can be applied in any wire saw in which the sawing wire is guided by means of grooved wire guide rollers and these wire guide rollers comprise a core consisting of a first material and a jacket consisting of a second material and enclosing the core.

A wire guide roller (1) is a circular cylindrical body comprising a roller core (core) (1*a*) consisting of a first material and having two side surfaces (end faces) and a lateral surface. The wire guide roller is mounted rotatably along its longitudinal axis.

The lateral surface of the roller core (1*a*) is preferably enclosed by a jacket (1*b*) consisting of a second material. Parallel grooves for guiding the sawing wire are cut into the jacket (1*b*). At least two wire guide rollers span a wire web consisting of wire sections arranged parallel, said wire web sawing the workpiece into a multiplicity of wafers during wire sawing.

FIG. 1 shows the basic construction of a wire web of a wire saw, comprising two wire guide rollers (1) with sawing wires (2) running parallel. The wire guide rollers (1) have grooves that guide the sawing wire (2). They are mounted rotatably about a longitudinal axis (3) and are fixed to the machine frame of the wire saw by means of at least one fixed bearing.

The core (1*a*) of the wire guide roller (1) preferably consists of steel, aluminum or a composite material, for example glass fiber or carbon fiber reinforced plastics. In the method according to the invention, the core (1*a*) comprises at least two separate cavities in the form of chambers and/or channels which are suitable for receiving a temperature-regulating means.

The jacket (1*b*) enclosing the lateral surface of the core (1*a*) of the wire guide roller (1) preferably consists of polyurethane (PU) or a polyester-based or polyether-based polyurethane, as described by DE 10 2007 019 566 B4, for example.

In accordance with the prior art, workpieces for being sawn in a wire saw are fixed to a saw strip (mounting beam) in such a way that the longitudinal axis of the workpiece runs parallel to the longitudinal axes (3) of the wire guide rollers (1).

A saw strip is an elongate strip which is produced from a suitable material, for example from graphite, glass, ceramic or a plastic, and which is provided for fixing a workpiece during the wire sawing process. By way of example, the fixing surface of a saw strip for a circular cylindrical workpiece is preferably shaped concavely, such that the shape of the fixing surface matches the convex shape of the workpiece.

The saw strip is fixed either directly or by means of a corresponding device in the wire saw, such that the workpiece connected to the saw strip is fixed in the wire saw.

Heat arises as a result of the cutting of the workpiece during wire sawing, said heat leading firstly to heating of the workpiece but also, via the sawing wire, to heating of the wire guide roller (1).

The heating of a material can lead to a more or less pronounced expansion (positive coefficient of expansion) or contraction (negative coefficient of expansion) of the material and is designated hereinafter generally as thermally induced change in length.

In the case of workpieces composed of semiconductor materials, the supply of heat leads to an expansion of the workpiece.

Depending on the fixing of the workpiece in the wire saw, thermally induced change in length of the workpiece together with the saw strip can take place along the longitudinal axis of the workpiece either in both directions or only in one direction. By way of example, if a workpiece composed of semiconductor material is fixed in the wire saw in such a way that one side of the saw strip or of the fixing device bears directly against the machine frame and the opposite side (in the direction of the longitudinal axis of the workpiece) has no contact with a surface that impedes the expansion, thermally induced change in length of the workpiece will preferably take place only on one side in the opposite direction to the machine frame.

The present invention makes it possible to compensate for thermally induced change in length of the workpiece during wire sawing by means of a likewise thermally induced change in length of the wire guide rollers (1) spanning the wire web, in particular of the jacket (1*b*) enclosing the core (1*a*) of the wire guide roller (1), in a targeted manner by means of a temperature gradient.

Within the meaning of this invention, the term "thermally induced change in length" is understood to mean the change in length of a material that is caused by heat or cold.

As a result of thermally induced change in length of the jacket (1*b*) enclosing the lateral surface of the core (1*a*) of the wire guide roller (1), the position of the grooves cut into the jacket (1*b*) for wire guiding relative to the cut notches in the workpiece that are caused by the wire web is kept constant during the wire sawing process.

Preferably, a thermally induced change in length of the jacket (1*b*) of the wire guide rollers (1) is continuously adapted to thermally induced change in length of the workpiece during the wire sawing process. If the workpiece expands by 5 μm, for example, as a result of the heating, the jacket (1*b*) is likewise expanded by 5 μm by means of a corresponding temperature change.

Preferably, the change in length of the workpiece is tracked by continuous or discontinuous measurement during wire sawing and the length of the jacket (1*b*) of the wire guide rollers (1) will be adapted by corresponding temperature regulation during wire sawing.

Preference is likewise given to measuring the thermally induced change in length for a workpiece during wire sawing, and to using the data determined for the adaptation of the length of the jacket (1*b*) of the wire guide rollers (1) by means of corresponding temperature regulation during wire sawing in the case of workpieces of the same size.

Preference is likewise given to calculating the thermally induced change in length of the workpiece by way of the temperature of the workpiece during wire sawing, and to adapting the length of the jacket (1*b*) by means of corresponding temperature regulation during wire sawing.

The thermally induced change in length of the jacket (1*b*) enclosing the lateral surface of the core (1*a*) is carried out by means of temperature regulation of the core (1*a*) of the wire guide roller (1).

The thermal change in length of the jacket (1*b*) of the wire guide roller (1) enclosing the lateral surface of the core (1*a*) is dependent on the respective material of the roller core (1*a*), the stability with which the jacket (1*b*) encloses the lateral surface of the core (1*a*), and on the material and thickness of the jacket (1*b*) and the temperature acting on the material. By way of example, with supply of heat, high-grade steel expands to a greater extent than Invar, an iron-nickel alloy having a very low coefficient of thermal expansion.

A jacket (1*b*) adhesively bonded for example to the lateral surface of the core (1*a*) of the wire guide roller (1), depending on the thickness of the jacket, changes length under thermal influence differently than a jacket (1*b*) which is clamped over the lateral surface but otherwise has no other fixing. In this case, the roughness of the lateral surface also affects the thermally induced change in length of the jacket (1*b*) and can be used as an additional variable for controlling the thermally induced change in length of the jacket (1*b*). In an embodiment, the jacket is configured to expand laterally over the at least one clamping ring, thereby controlling thermally induced expansion of the jacket.

Figure 2A:
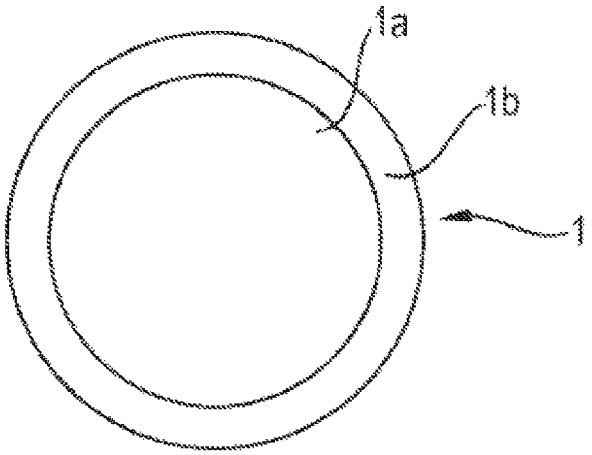
FIG. 2*a*: Example according to an embodiment of the invention showing the wire guide roller in which the roller core is longitudinally enclosed by a jacket.

FIG. 2*a* shows a wire guide roller (1) in which the roller core (1*a*) is longitudinally enclosed by a jacket (1*b*) (FIG. 2*a*). FIGS. 2*b* to 2*g* schematically show preferred embodiments for a wire guide roller (1) in which the roller core (1*a*) is longitudinally enclosed by a jacket (1*b*), with which embodiments the different change in length of the jacket (1*b*) in comparison with the roller core (1*a*) can be controlled in a targeted manner.

Preferably, the jacket (1*b*) can be additionally fixed by a respective clamping ring (4) on one side or both sides of the wire guide roller (1) (FIGS. 2*b* to 2*g*).

A clamping ring (4) is a ring-shaped body having two side surfaces, an inner surface facing the core of the wire guide roller and an outer surface opposite the inner surface.

Figure 2B:
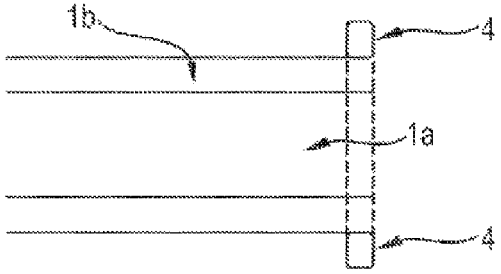
FIG. 2*b*: Example according to an embodiment of the invention showing a roller core longitudinally enclosed by a jacket wherein a clamping ring additionally fixes the coating on the core of the wire guide roller by the inner side of the clamping ring pressing the jacket against the lateral surface of the core.

In a first embodiment, the clamping ring (4) additionally fixes the coating (1*b*) on the core (1*a*) of the wire guide roller (1) by virtue of the inner side of the clamping ring (4) pressing the jacket (1*b*) against the lateral surface of the core (1*a*) (FIG. 2*b*). Therefore, this first embodiment is also suitable for avoiding or reducing a thermally induced contraction of the jacket.

In a second embodiment, the inner side of the clamping ring (4) comes into direct contact with the lateral surface of the core (1*a*). In this embodiment, the jacket (1*b*) preferably butts against a side surface of the clamping ring (4) (FIG. 2*c*).

Likewise with preference, the at least one side surface of the jacket (1*b*) and the side surface of the clamping ring (4) that is opposite to said side surface are not in direct contact with one another, that is to say that there is a spacing having a defined length between the two side surfaces. In the event of a thermally induced increase in the length of the jacket (1*b*), the jacket can expand in an unimpeded manner over the length of the spacing between the two side surfaces (jacket and clamping ring).

Figure 2C:
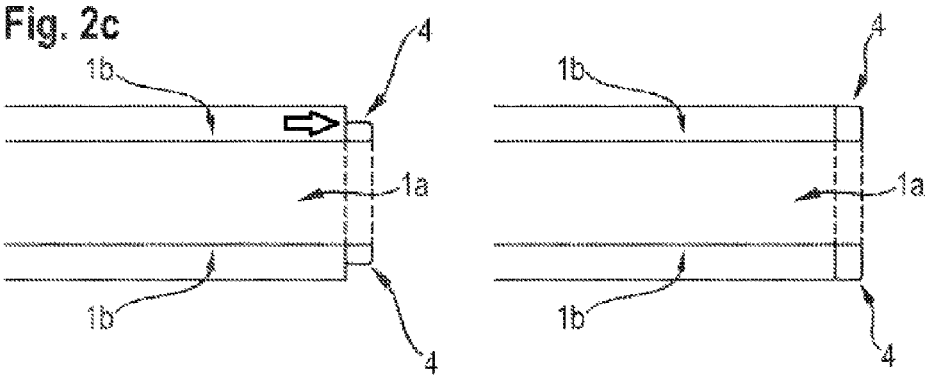
FIG. 2*c*: Example according to an embodiment of the invention showing a roller core longitudinally enclosed by a jacket wherein the jacket butts against a side surface of the clamping ring.
Figure 2D:
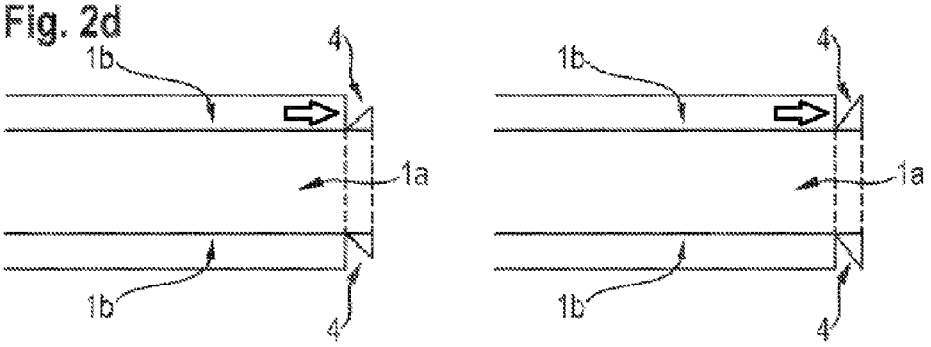
FIG. 2*d*: Example according to an embodiment of the invention showing the side surface of the clamping ring as perpendicular.
Figure 2E:
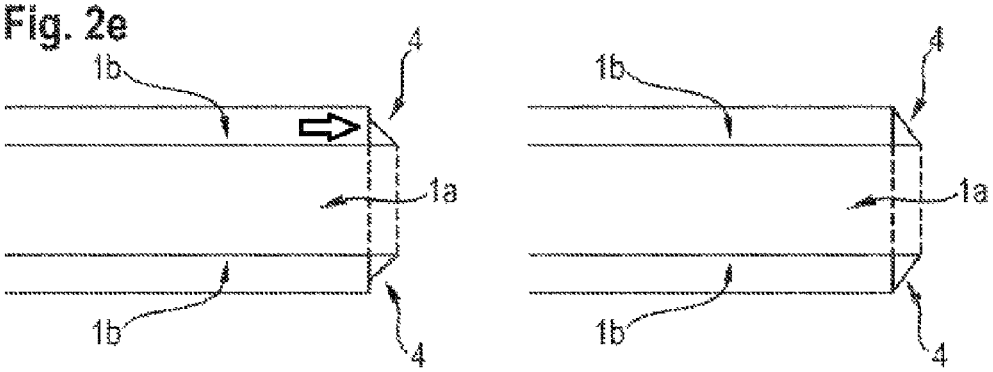
FIG. 2*e*: Example according to an embodiment of the invention showing the side surface of the clamping ring as outwardly linearly beveled.
Figure 2F:
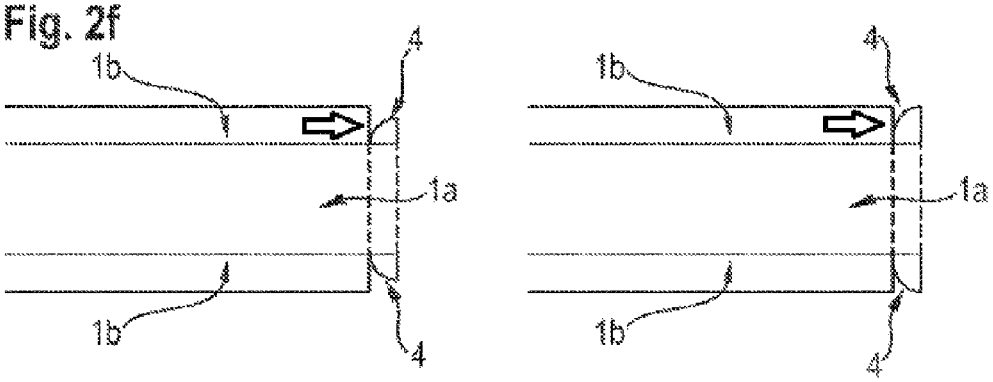
FIG. 2*f*: Example according to an embodiment of the invention showing the side surface of the clamping ring as convex.

In this second embodiment, the clamping ring (4) preferably terminates with the outer side of the jacket (1*b*), that is to say that the external diameters of the clamping ring (4) and of the jacket (1*b*) are identical (right-hand part of FIG. 2*c*).

Likewise with preference, in this second embodiment, the external diameter of the clamping ring (4) is somewhat smaller than the external diameter of the jacket (1*b*), that is to say that the surface of the jacket (1*b*) projects beyond the top side of the clamping ring (4), in other words the jacket is somewhat higher than the clamping ring (4) (left-hand part of FIG. 2*c*).

When two clamping rings (4) are used, a combination of the first and second embodiments is also preferred in order to enable a targeted expansion of the jacket toward one side.

In the second embodiment, a thermally induced expansion of the jacket (1*b*) of the wire guide roller (1) can additionally be influenced in a targeted manner by that side surface of the clamping ring (4) which bears against the jacket (1*b*), by virtue of the fact that the clamping ring enables the partial lateral expansion of the jacket (1*b*) across the clamping ring (4).

Figure 2G:
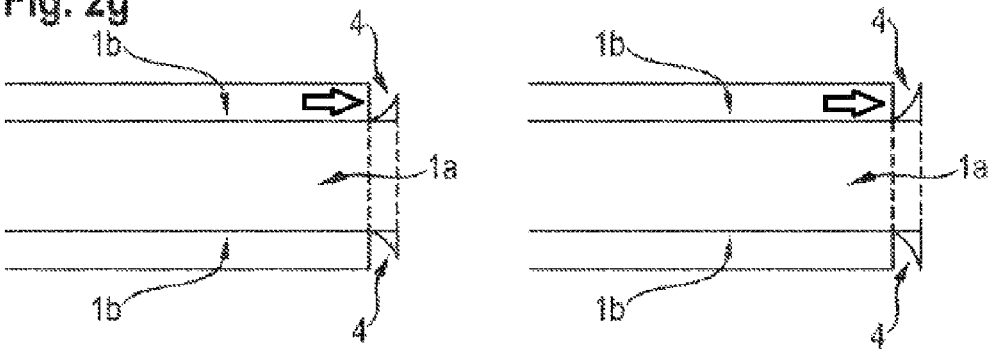
FIG. 2*g*: Example according to an embodiment of the invention showing the side surface of the clamping ring as concave.

For this purpose, that side surface of the clamping ring (4) which faces the jacket (1*b*) can be perpendicular (FIG. 2*d*), outwardly linearly beveled (FIG. 2*e*), convex (FIG. 2*f*) or concave (FIG. 2*g*). In this case, the height of the clamping ring (4) can be smaller than the jacket (1*b*) (left-hand illustrations in FIGS. 2*d* to 2*g*) or of the same height as the jacket (1*b*) (right-hand illustrations in FIGS. 2*d* to 2*g*).

Both the height of the side surface of the clamping ring (4) in relation to the height of the jacket (1*b*) and the shape of the side surface directly affect the thermally induced linear expansion, since the resistance of the clamping ring (4) to an expansion of the jacket in the longitudinal direction can thereby be influenced in a targeted manner. The side surface of the clamping ring (4) offers different resistance depending on the embodiment of the thermally induced expansion of the jacket (1*b*).

In the method according to the invention, the wire guide rollers (1) spanning the wire web are heated or cooled in a targeted manner during wire sawing, thus resulting in a thermally induced change in length of the jacket (1*b*) enclosing the lateral surface of the core (1*a*) along the longitudinal axis of the core (1*a*). In this case, by way of example, a jacket (1*b*) composed of polyurethane (PU), upon heating of the wire guide roller having a core (1*a*) composed of INVAR by approximately 20° C., can expand in length more than the core (1*a*) approximately by a factor of 4 to 5, as a result of which thermally induced changes in length of the jacket (1*b*) can be carried out better.

Investigations by the inventors have shown that a controlled thermal expansion of the wire guide roller (1) or of the jacket (1*b*) enclosing the lateral surface of the core (1*a*), in each case along the longitudinal axis of the core (1*a*), has an advantageous effect on the surface geometry of the sawn wafers with regard to the local curvature of the wafers along a measurement track (LSR) running through the wafer center and the waviness (FIG. 3).

Figure 3A:
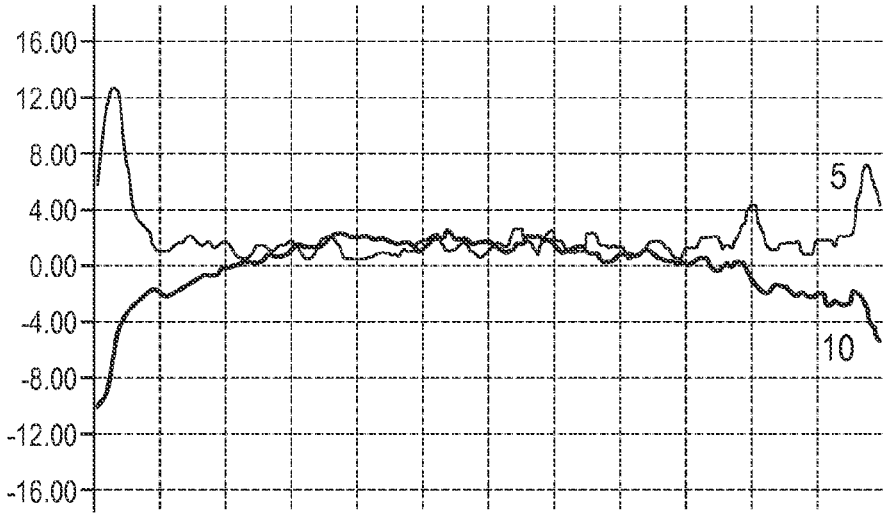
FIG. 3*a*: Surface profile (thickness of the sawn wafer) along the diameter of a wafer cut from a silicon single crystal by means of a wire saw by means of a method in accordance with the prior art.

FIG. 3*a* shows the surface profile (thickness of the sawn wafer) along the diameter of a wafer cut from a silicon single crystal by means of a wire saw by means of a method in accordance with the prior art.

Figure 3B:
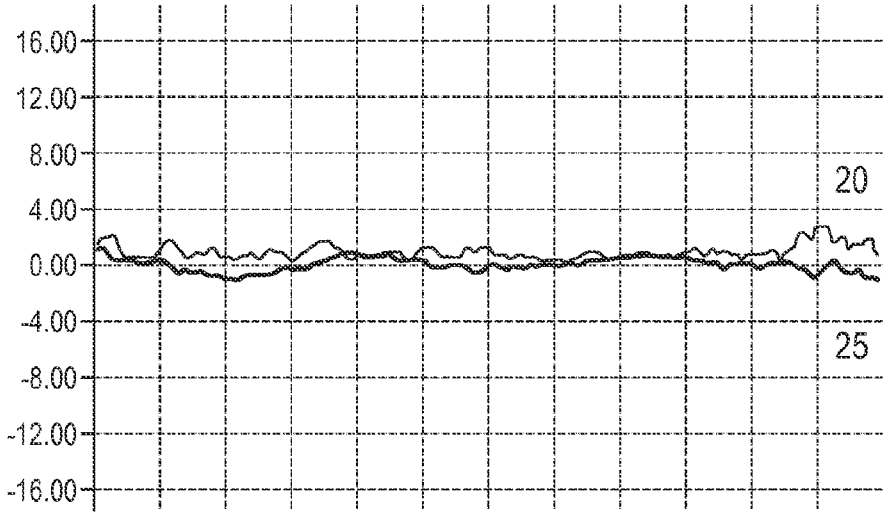
FIG. 3*b*: Surface profile (thickness of the wafer) along the diameter of a wafer cut from a silicon single crystal by means of a wire saw by means of a method according to the invention.

FIG. 3*b* shows the surface profile (thickness of the wafer) along the diameter of a wafer cut from a silicon single crystal by means of a wire saw by means of a method according to the invention. A significantly better surface geometry is obtained with the method according to the invention, since both the workpiece and the wire guide roller (1) or the coating (1*b*) of the wire guide roller (1) are subject to a thermally induced change in length during wire sawing.

In the course of their investigations, the inventors ascertained that a workpiece does not expand uniformly toward both sides along the longitudinal axis during wire sawing if said workpiece or the fixing device for said workpiece in the wire saw bears against the machine frame on one side. In this case, the thermally governed change in length of the workpiece takes place along the longitudinal axis of the workpiece preferably in the direction of the side facing away from the machine frame.

The following examples constitute a non-exhaustive compilation of possible embodiments, without the method according to the invention being restricted to these embodiments. Each of the following embodiments can be embodied with one or two clamping rings (4) and without a clamping ring (4). With the use of one clamping ring (4) or of two clamping rings (4), it is possible to use the clamping ring (4) in one of the embodiments for the clamping rings (FIG. 2) in order to additionally regulate the thermally induced change in length of the jacket (1*b*) of the wire guide roller (1).

The thermally induced change in length of the jacket (1*b*) is effected by conduction of heat between or transfer of cold from the roller core (1*a*) of the wire guide roller (1). For this purpose, the internal construction of the core (1*a*) of the wire guide roller (1) has at least two separate cavities (5).

The two separate cavities enable different temperature regulation of the wire guide roller in different regions. By way of example, the first cavity can be temperature-regulated to a temperature T1 and the second cavity to a temperature T2 not equal to the temperature T1. The different temperatures in the two cavities lead to different temperature ranges on the core surface and thus to different temperature regulation of the jacket (1*b*), such that the thermally induced change in length of the jacket (1*b*) can be realized differently along the longitudinal axis of the roller core (1*a*).

Figure 4A:
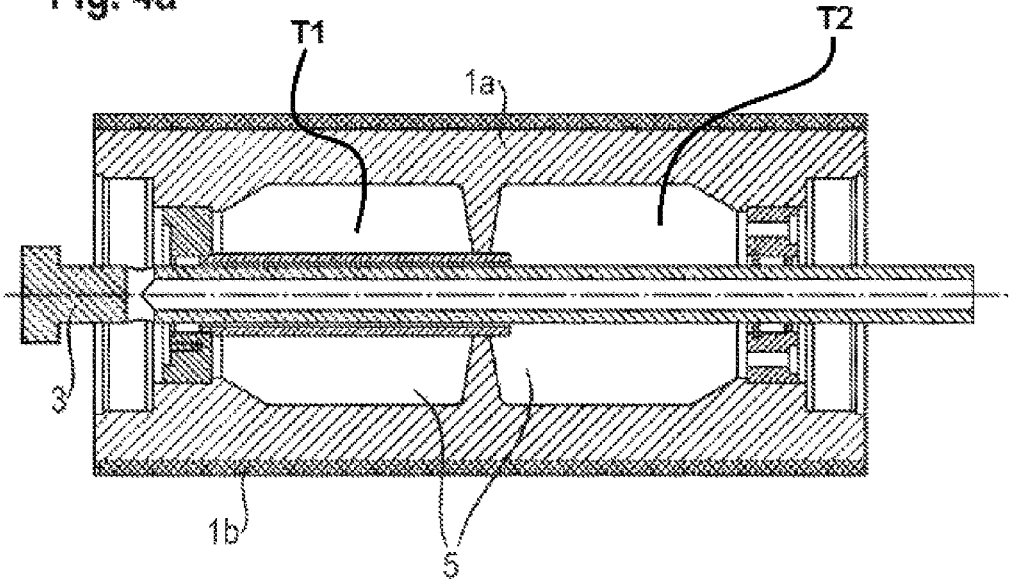
FIG. 4*a*: Example according to an embodiment of the invention showing the core enclosed by a jacket which has cavities in the form of chambers; the core having two separate cavities which are closely adjacent to one another.
Figure 4B:
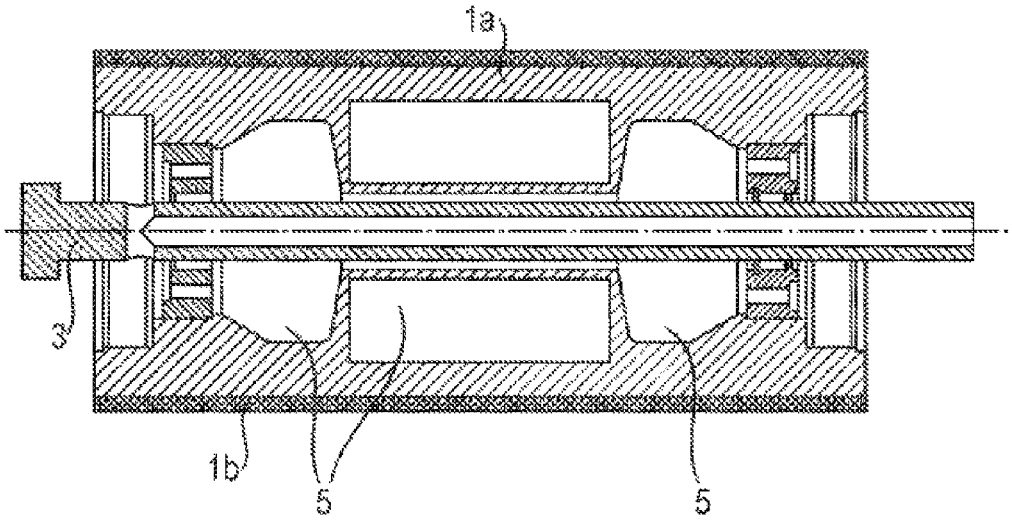
FIG. 4*b*: Example according to an embodiment of the invention showing the core having three separate cavities.
Figure 4C:
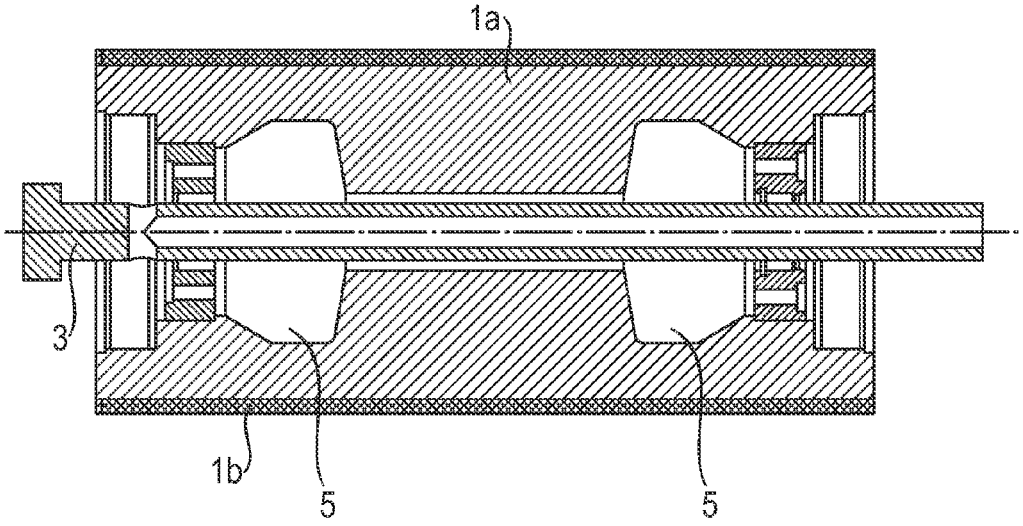
FIG. 4*c*: Example according to an embodiment of the invention showing a wire guide roller having two separate cavities, which are separated far from one another by solid core material.

FIG. 4 shows some embodiments in which the core (1*a*) enclosed by a jacket (1*b*) has cavities in the form of chambers (5). The core (1*a*) is mounted axially rotatably on a rotary spindle (3). In FIG. 4*a*, the core (1*a*) has 2 separate cavities (5), which are closely adjacent to one another. FIG. 4*b* shows an embodiment with three separate cavities (5), wherein the middle cavity can also be filled with a thermally insulating material. FIG. 4*c* shows a wire guide roller having two separate cavities, which are separated far from one another by solid core material.

In order to cool or heat the core (1*a*) of the wire guide roller (1) in a targeted manner, the core (1*b*) preferably has at least two separate cavities (5) in the form of chambers (5) and/or channels (5) which can be filled with, or through which can flow, a temperature-regulating medium (cooling medium or a heat-supplying medium).

The following exemplary embodiments of the core (1*a*) of the wire guide roller (1) are restricted only to the core (1*a*) of the wire guide roller (1) having at least two separate cavities (5). A description of the rotary spindles (3) is omitted for reasons of clarity. In each embodiment, a respective clamping ring (4) is situated either on no side, on one side or on both sides of the wire guide roller (1) in order to be able to additionally influence or prevent the thermally induced change in length of the jacket (1*b*) in a targeted manner.

Preferably, at least two separate channels (5) which can be filled separately with temperature-regulating medium extend in the core (1*a*) of the wire guide roller (1), wherein the at least two channels (5) are arranged in such a way that they do not overlap, but rather, relative to the longitudinal axis of the roller core (1*a*), lie alongside one another.

Particularly preferably, the core (1*a*) of the wire guide roller (1) comprises at least one, especially preferably two or more separate chambers (5), wherein a chamber (5) is a generally circular cylindrical cavity (5) situated symmetrically with respect to the longitudinal axis (3) in the core (1*a*) of the wire guide roller (1). If the cavity (5) is a chamber (5), then the chambers (5) are positioned along the longitudinal axis of the wire guide roller in such a way that the chambers (5) lie alongside one another.

Preferably, a temperature-regulating medium can flow in circulation through each channel or each chamber (5), wherein mutually separate temperature-regulating medium circulations, the temperature of which can be individually regulated, are preferred for each channel or each chamber (5). As a result, individual regions of the roller core (1*a*) can be temperature-regulated in a targeted manner, such that a different change in length of the jacket (1*b*) is brought about along the longitudinal axis (3) of the roller core (1*a*) by means of the temperature gradient obtained in the roller core (1*a*).

The diameter of the individual channels or the size of the individual chambers (5) can be identical or different. Preferably, the wall thickness, i.e. the distance between the circumferential channel or chamber inner side and the circumferential lateral surface of the core (1*a*) that comes into contact with the jacket (1*b*) is constant for all channels or chambers (5).

In the following preferred embodiments, only chambers (5) are mentioned for the sake of clarity. However, the chambers (5) can also be replaced or supplemented by corresponding channels.

In a first particularly preferred embodiment of the method according to the invention, the core (1*a*) comprises two separate chambers (5) preferably of the same size (FIG. 4*a*). A temperature-regulating medium flows through only one chamber (5) of these chambers (5).

By way of example, if the workpiece is fixed in the wire saw in such a way that a temperature-induced change in length of the workpiece is possible only on the side facing away from the machine frame, for example because the saw strip bears against the machine frame, preferably only that chamber (5) in the wire guide roller which faces away from the machine frame is temperature-regulated.

In a second particularly preferred embodiment of the method according to the invention, the core (1*a*) comprises two separate chambers (5) preferably of the same size (FIG. 4*a*). A temperature-regulating medium flows through both chambers (5). Preferably, both chambers (5) are supplied separately with temperature-regulating medium via separate temperature-regulating medium circulations, the temperature of which is individually adjustable.

In the example mentioned above, it is possible, by way of example, for the chamber facing the machine frame to be temperature-regulated to a lesser extent than the chamber facing away from the machine frame.

In a third particularly preferred embodiment of the method according to the invention, the core (1*a*) comprises three separate chambers (5) preferably of the same size along the longitudinal axis (3), two lateral chambers (5) and one middle chamber (5) (FIGS. 4*b* and 4*c*). A temperature-regulating medium flows through the respective lateral chambers (5), and the middle chamber (5) can be an insulated cavity (FIG. 4*b*), a chamber completely filled with an insulating material (FIG. 4*b*) or can be solidly filled with the core material (FIG. 4*c*). A temperature-regulating medium flows through the two outer chambers (5). Preferably, both chambers (5) are supplied separately with a temperature-regulating medium which can have different temperatures.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A method of sawing a multiplicity of wafers from a workpiece using a wire web of a wire saw, the method comprising:

providing a wire web including a plurality of parallel wire sections wherein the wire web is spanned by at least two wire guide rollers, each wire guide roller comprising a core having two sides surfaces and a lateral surface, each core being composed of a first material and comprising at least two separate cavities;

rotatably mounting each core along its longitudinal axis;

enclosing the lateral surface of each core by a jacket composed of a second material, the jacket being fixed on at least one side surface of the wire guide roller using at least one clamping ring, and the jacket being configured to expand laterally over the at least one clamping ring, thereby controlling thermally induced expansion of the jacket; and cutting parallel grooves for guiding the wire sections of the wire web into the jacket, wherein a length of the jacket is altered thermally by means of at least one cavity containing a first temperature-regulating medium.

2. The method of claim 1, wherein each of the at least two cavities contain a second temperature-regulating medium, each temperature-regulating medium having a different temperature.

3. The method of claim 2, wherein the first and second temperature regulating medium are the same.

4. The method of claim 2, wherein the first and second temperature regulating medium are the different.

5. The method of claim 1, wherein the core comprises iron and nickel.

6. The method of claim 1, wherein the core comprises high-grade steel.

7. The method of claim 1, wherein the core comprises aluminum.

8. The method of claim 1, wherein the core comprises a composite material.

9. The method of claim 1, wherein the jacket comprises a polyurethane.

10. The method of claim 1, wherein the jacket comprises a polyester.

11. The method of claim 1, wherein the jacket comprises a polyester-based polyurethane.

12. The method of claim 1, wherein an external diameter of the at least one clamping ring is smaller than an external diameter of the jacket.

13. The method of claim 1, wherein at least one jacket side surface and a clamping ring side surface opposite the jacket side surface are not in direct contact with one another.

14. The method of claim 1, wherein the jacket and the at least one clamping ring have the same outer diameter.

15. The method of claim 1, wherein a side surface of the at least one clamping ring facing the jacket is perpendicular with respect to the jacket.

16. The method of claim 1, wherein a side surface of the at least one clamping ring facing the jacket is outwardly linearly beveled.

17. The method of claim 1, wherein a side surface of the at least one clamping ring facing the jacket is convex.

18. The method of claim 1, wherein a side surface of the at least one clamping ring facing the jacket is concave.

19. The method of claim 1, wherein the cavities are symmetric with respect to the longitudinal axis of at least one of the cores.

20. The method of claim 2, further comprising:

separately circulating the first and second temperature-regulating mediums into separate cavities using mutually separate temperature-regulating medium circulations.

* * * * *